US007392752B2

(12) United States Patent
Okazaki et al.

(10) Patent No.: US 7,392,752 B2
(45) Date of Patent: Jul. 1, 2008

(54) SOLID FUEL BOILER AND METHOD OF OPERATING COMBUSTION APPARATUS

(75) Inventors: Hirofumi Okazaki, Hitachinaka (JP); Masayuki Taniguchi, Hitachinaka (JP); Kenji Yamamoto, Hitachinaka (JP); Kenji Kiyama, Kure (JP)

(73) Assignees: Hitachi, Ltd., Tokyo (JP); Babcock Hitachi Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/191,958

(22) Filed: Jul. 29, 2005

(65) Prior Publication Data

US 2005/0257721 A1 Nov. 24, 2005

Related U.S. Application Data

(63) Continuation of application No. 10/744,101, filed on Dec. 24, 2003, now Pat. No. 6,938,560.

(30) Foreign Application Priority Data

Dec. 26, 2002 (JP) ..... 2002-377095

(51) Int. Cl.
*F23B 5/02* (2006.01)

(52) U.S. Cl. ..... 110/204; 110/345

(58) Field of Classification Search ..... 110/204, 110/343, 345, 265; 431/174, 178, 115, 8, 431/9

See application file for complete search history.

(56) References Cited

U.S. PATENT DOCUMENTS 3,927,627 A * 12/1975 Brunn ..... 110/342
4,249,470 A * 2/1981 Vatsky ..... 110/232
4,294,178 A 10/1981 Borio et al.
4,739,713 A 4/1988 Vier et al.
5,044,932 A 9/1991 Martin et al.

(Continued)

FOREIGN PATENT DOCUMENTS

DE 195 20 720 A1 12/1996

(Continued)

OTHER PUBLICATIONS

Japanese Office Action Issued in corresponding Japanese Patent Application No. JP 2002-377095, dated Jan. 4, 2007.

(Continued)

*Primary Examiner*—Kenneth B Rinehart
(74) *Attorney, Agent, or Firm*—McDermott Will & Emery LLP

(57) ABSTRACT

There is disclosed a solid fuel boiler including: a furnace including a plurality of solid fuel burners and a furnace wall to perform horizontal firing; a duct through which a part of combustion exhaust gas recirculates to a furnace from a downstream side of the furnace; heat exchanger tubes disposed on a furnace wall and in a heat recovery area of the furnace; and recirculation gas ports via which the recirculation gas is supplied to a reducing flame portion of the burners in the furnace without combining the gas with a flame in the vicinity of an outlet of the burner, so that molten ash is prevented from firmly sticking to the furnace wall and thermal NOx, fuel NOx, and unburned carbon.

14 Claims, 7 Drawing Sheets

U.S. PATENT DOCUMENTS

| | | | |
|---|---|---|---|
| 5,154,599 | A | 10/1992 | Wunning |

FOREIGN PATENT DOCUMENTS

| | | | |
|---|---|---|---|
| DE | 195 41 178 | A1 | 5/1997 |
| DE | 197 22 070 | A1 | 12/1998 |
| JP | 49-105234 | | 10/1974 |
| JP | 58-033019 | | 2/1983 |
| JP | 59-29504 | | 2/1984 |
| JP | 59-157406 | A | 9/1984 |
| JP | 60-53702 | A | 3/1985 |
| JP | 60-171308 | A | 9/1985 |
| JP | 2-101302 | A | 4/1990 |
| JP | 03-095302 | | 4/1991 |
| JP | 3-286906 | A | 12/1991 |
| JP | 4-165204 | A | 6/1992 |
| JP | 2000-46304 | A | 2/2000 |
| WO | WO 03/081135 | A1 | 10/2003 |

OTHER PUBLICATIONS

Japanese Office Action issued in Japanese Patent Application No. JP 2002-377095 dated Jun. 26, 2007.

* cited by examiner

SOLID FUEL BOILER AND METHOD OF OPERATING COMBUSTION APPARATUS

RELATED APPLICATION

This application is a continuation of application Ser. No. 10/744,101 filed Dec. 24, 2003 now U.S. Pat. No. 6,938,560.

BACKGROUND OF THE INVENTION

1. Field of the Invention

The present invention relates to a solid fuel boiler and a method of operating a combustion apparatus.

2. Description of the Related Art

For a solid fuel boiler, there have been demands for combustion at a high efficiency and for reduction of NOx and CO from environmental problems. To meet these demands, methods have been used such as combustion at a low air ratio, a two-stage combustion method, an exhaust gas re-circulation, and the use of a low NOx burner.

In the two-stage combustion method, combustion air is supplied from the burner and air inlet ports (hereinafter referred to as after air ports) disposed on the downstream side of the burner. An air amount in the burner is reduced, and thus, a reducing region in which oxygen is insufficient is formed in a furnace so as to reduce NOx. Furthermore, air is supplied from the after air ports so as to reduce unburned carbon.

In a method of recirculating exhaust gas, a part of the exhaust gas exhausted from the furnace is introduced into the furnace via exhaust gas ports disposed in the furnace on an upstream side of a burner stage or on a downstream side of the after air ports. Since the exhaust gas is recirculated into the furnace, a flow volume of gas flowing through the furnace is increased, and a heat absorption ratio is adjusted in a heat exchanger (water pipe) disposed on a furnace wall, and a heat exchanger disposed in a heat recovery area connected to an outlet of the furnace. Accordingly, steam is stably produced at a higher temperature and pressure, and it is possible to operate the boiler with high efficiency.

In JP-A-2000-46304, a technique is disclosed in which a part of combustion exhaust gas is recirculated to the furnace in order to reduce a thermal NOx concentration.

In this related art, a supply port of the combustion exhaust gas, having an annular section, is disposed in a wind box so as to surround a burner throat, a secondary air supply port and a tertiary air supply port. When such an annular supply port is disposed, an initial flame (having a temperature of about 1000° C.) in the vicinity of the throat of the burner is mixed with the exhaust gas, and the flame sometimes becomes unstable. As a result of the instability of the combustion of the initial flame, fuel NOx cannot be decreased sufficiently. Especially, when air spouted via the air nozzle of the burner is swirled, the initial flame in the vicinity of the burner throat is remarkably mixed with recirculation gas.

Moreover, as disclosed in JP-A-3-95302, there is also a method of supplying the recirculation gas in the vicinity of a bottom of the furnace. However, there is a possibility that the flame is blown off, and stable combustion cannot be performed.

As described above, the decrease of the flame temperature is a problem in a portion of the furnace having a high thermal load. When a maximum temperature of the flame is suppressed, it is possible to suppress ash stick troubles caused by melting or softening of ash on a wall surface, and generation of nitrogen oxide (thermal NOx). When stable combustion can be performed in the portion of the furnace having the low thermal load (corresponding to the initial flame whose temperature is about 1000° C.), fuel NOx and unburned carbon can be reduced.

BRIEF SUMMARY OF THE INVENTION

An object of the present invention is to provide a solid fuel boiler and a combustion method thereof in which thermal NOx, fuel NOx, unburned carbon, and molten ash sticking to a furnace wall can be reduced without impairing flame stability.

According to the present invention, in a solid fuel boiler of a system for recirculating a part of combustion exhaust gas to a furnace, recirculation gas is supplied into the furnace in a manner to prevent the gas from being mixed with a burner initial flame and to mix the gas with a reducing flame just after the initial flame. Accordingly, the temperature of a high temperature region (about 1500° C. or more) in which NOx is produced is lowered so as to reduce thermal NOx.

In the boiler according to the present invention, as shown in FIG. 2, the recirculation gas spouted from a recirculation gas port is supplied in a manner to be separated from the initial flame in the vicinity of a burner throat, and is supplied in a manner to be well mixed with a reducing flame at a high temperature (about 1500° C. or more).

According to the present invention, there is provided a boiler including: a furnace including a plurality of burners to perform horizontal firing; a duct through which a part of combustion exhaust gas recirculates to a furnace from a downstream side of the furnace; and heat exchanger tubes disposed on a furnace wall and in a heat recovery area of the furnace. Further, gas supply ports are disposed in the furnace on a burner mounting surface or a non-mounting surface, via which the combustion exhaust gas is supplied into the furnace.

For an operation of the boiler, in a usual case, the operation at a low air ratio is performed with high efficiency. Furthermore, in recent years, a two-stage combustion method has frequently been used in order to reduce NOx. In the two-stage combustion, excess fuel combustion is performed near a burner setting area (hereinafter referred to as a burner zone) in the furnace. A flame has the highest temperature in the vicinity of an air ratio of 1.0 (especially, about 0.95, in which air is slightly insufficient), and therefore the flame temperature in the burner zone is increased. Further, the furnace has been requested to be reduced in size in order to save cost, and a thermal load per a furnace section has tended to be high in recent years.

A plurality of burners are arranged to make a plurality of columns (column) and a plurality of stages (row). The recirculation gas ports are disposed above the burners of an upper stage. Other recirculation gas ports are disposed especially near the burners of middle column, and the recirculation gas is entirely supplied to a high-temperature zone in a center part of the furnace.

There are mainly two reaction mechanisms of nitrogen oxide (hereinafter referred to as NOx) in the furnace: NOx produced from nitrogen in fuel (hereinafter referred to as fuel NOx); and NOx produced from nitrogen in the air at high temperature in the flame (hereinafter referred to as thermal NOx).

Therefore, NOx is rapidly increased when the thermal load in the furnace is increased. And when the thermal load on the furnace wall increases, the temperature of ash sticking onto a water pipe disposed on the wall rises, and the ash is sometimes molten. The molten ash is apt to firmly stick to the water pipe and thicken.

Therefore, it is considered that when the thermal load increases, parts of the molten ash sometimes coagulate with each other and make troubles in the boiler operation, for example, to prevent the ash from being discharged. These troubles are easily caused, especially when a melting or softening temperature of the ash is low compared to the furnace temperature.

When a gas recirculation method is applied and recirculation gas is supplied from the bottom of the furnace, the flame temperature is decreased by the thermal capacity of the recirculation gas.

And the residence time at the burner zone is decreased since the flow rate in the furnace is increased. So, the flame temperature at the burner zone is decreased, and the ash trouble is reduced.

However, it is considered that when the recirculation gas is mixed via the bottom of the furnace, the recirculation gas is considered to flow only through a specific portion depending on a flowing situation in the furnace. In the case that the recirculation gas is supplied from the bottom of the furnace and using opposite firing system, when the recirculation gas flows along the front or back wall (burner setting wall), there is a possibility that the ignition of the fuel are forced delay. In such a case, the unburned carbon and CO are sometimes increased. And blow-off or flameout rarely occurred.

Further, when the recirculation gas flows along the side wall, the recirculation gas does not flow through a center portion having the highest temperature zone in the furnace. So, it is considered that the effect of recirculation gas method is not obtained. Especially, in the burner or burners disposed in the lowermost stage among the burners, since the temperature of the peripheral wall of the furnace is low, when the flame temperature is lowered by the recirculation of the exhaust gas, the combustion easily becomes unstable.

According to the present invention, there is provided a solid fuel boiler including: a furnace including a furnace wall provided with a plurality of solid fuel burners so as to perform horizontal firing; a duct through which a part of combustion exhaust gas recirculates to a furnace from a downstream side of the furnace; heat exchanger tubes disposed on the furnace wall and in a heat recovery area of the furnace; and recirculation gas ports which supply the recirculation gas into a reducing flame portion of the furnace without combining the gas with the flame in the vicinity of an outlet of the burners.

In one aspect according to the present invention, the recirculation gas port may be disposed in the furnace on a burner mounting surface. The center of the recirculation gas port may be disposed in a position as high as or higher than the center of the throat of the burner.

In another aspect, the recirculation gas port may be disposed on the burner mounting surface of the furnace outside a wind box of the boiler. In further aspect, a sectional center of the recirculation gas port may be apart from an outer periphery of the throat of the burner by one or more times a diameter (hydraulic diameter) of the throat.

Moreover, the sectional center of the recirculation gas port is preferably disposed apart from the outer periphery of the throat of the burner by 1.1 to four times, especially 1.3 to 1.7 times the diameter of the burner. In the present invention, when the diameter of the burner throat or the recirculation gas port is referred to, hydraulic diameter is meant. The distance between the burners is determined by the design of the heat load, and is usually less than eight times the diameter of the burner throat. Therefore, when the recirculation gas port is disposed apart from each of the burners by an equal distance, the recirculation gas port is apart from the outer periphery of the burner throat by a distance less than four times the diameter of the burner throat.

The sectional shape of the recirculation gas port is preferably substantially circular for the convenience of the manufacturing of the recirculation gas port and in order to avoid unnecessary mixture with the initial flame of the burner. If the recirculation gas port has an elliptical section shape, the recirculation gas is easily mixed with the initial flame of the burner as compared with the recirculation gas port having the circular shape.

The recirculation gas ports can be disposed in the furnace on a surface different from the burner mounting surface. In this case, the setting conditions different from those in the case where the recirculation gas ports are disposed on the burner mounting surface are taken into consideration. That is, the recirculation gas port is disposed in such a manner that the sectional center of the recirculation gas port is disposed substantially as high as or slightly above the sectional center of the burner throat.

When the recirculation gas ports are disposed on the same plane as the burner mounting surface of the furnace, a central axis of the gas port may have right angles, or may be inclined, for example, by 15 or 10 degrees with respect to the furnace surface. It is important to design that the recirculation gas should not be mixed with the initial flame of the burner. When the recirculation gas ports are disposed on the same furnace surface as the burner mounting surface, if the inclination of the gas port is large, the burner throat is too close to the recirculation gas port, and the initial flame is mixed with the recirculation gas. Therefore, such arrangement has to be avoided. However, when the recirculation gas ports are disposed on a furnace wall portion other than the burner mounting surface, the above-described setting conditions can be moderate.

Needless to say, the recirculation gas port can also be disposed on the burner mounting surface of the furnace and the surface different from the mounting surface. In this case, the recirculation gas port disposed in each surface is designed in consideration of the above-described conditions.

The recirculation gas port is preferably disposed in the vicinity of the burner close to the furnace center among the burners. Even when the port is disposed in the vicinity of the burner which is not close to the furnace center, an effect of recirculation gas supply is small. Similarly, the recirculation gas ports may be disposed in the vicinity of the upper burner stage or right above the uppermost burner stage among the burners.

As the gas supplied from the recirculation gas port, it is preferably to use a mixed fluid of the combustion exhaust gas and air. At this time, an oxygen concentration contained in the gas supplied from the recirculation gas port is preferably 3 to 15%. This oxygen rich mixture gas is supplied so that the flame temperature is lowered, and the unburned carbon is reduced by the promotion of the combustion.

In the combustion method of the boiler according to the present invention, a flow volume of the gas spouted from the recirculation gas port is changed in accordance with an operation load of the boiler (fuel supply amount), and the spouted amount is controlled/increased, when the operation load exceeds the set condition.

Moreover, measurement means for measuring at least one of a radiation intensity of the flame, a furnace wall temperature, and a heat exchanger tube temperature is disposed on the furnace wall. When at least one of signal intensities indicating the radiation intensity, furnace wall temperature, and heat exchanger tube temperature by the measurement means exceeds the set condition, the flow volume of the gas spouted from the gas supply port is increased.

The set conditions of the operation load or the signal intensity are determined on the basis of a melting or softening point of the ash of the solid fuel combusted in the furnace.

When the supply port of the gas containing the combustion exhaust gas is disposed on the burner mounting surface, the recirculation gas can effectively be fed into the portion including the highest thermal load in the furnace. Therefore, the flame temperature can be lowered in the portion in which the thermal load is high. With the decrease of the flame temperature the temperature of the ash on the furnace wall will be lower and the slagging trouble of the ash by melting/softening can be prevented. With the decrease of the flame temperature, it is possible to reduce thermal NOx generation.

In another aspect according to the present invention, the invention can be applied to the boiler including the furnace in which a plurality of after air ports for two-stage combustion are disposed after a plurality of burners. Further, it can be applied to another boiler including a duct through which a part of the combustion exhaust gas recirculates into the furnace from the downstream side of the furnace, and heat exchanger tubes disposed on the furnace wall and in the heat recovery area of the furnace. Here, the gas supply port or recirculation gas port for supplying the gas containing the combustion exhaust gas or recirculation gas into the furnace may also be disposed in the furnace on the burner mounting surface.

When the recirculation gas is mixed into the furnace, the flow of the gas in the furnace and the mixture of the fuel and air are promoted. The flow volume of the gas spouted via the recirculation gas port is changed in accordance with the operation load (fuel supply amount) of the boiler, and the spouted amount may also be increased, when the operation load exceeds the set conditions.

The amount of the recirculation gas is usually about 20 volume % of the air amount supplied to the furnace, and the gas flow rate at the recirculation gas port is preferably set to 30 to 50 m/second.

Thermal NOx is remarkably generated with the high operation load. Therefore, the flow volume of the recirculation gas may also be increased only with the high operation load.

With a low operation load, the flow volume of the recirculation gas is reduced so as to reduce the power of a fan, and general efficiency (net thermal efficiency) of the combustion apparatus can be enhanced.

It is to be noted that the set conditions of the furnace wall signal intensity may also be determined on the basis of the melting or softening point of the ash of the solid fuel combusted in the furnace.

The boiler according to the present invention is especially effective for the boiler in which solid fuels such as pulverized coal, biomass, and waste materials are used as fuel.

Other objects, features and advantages of the invention will become apparent from the following description of the embodiments of the invention taken in conjunction with the accompanying drawings.

DETAILED DESCRIPTION OF THE INVENTION

Embodiments of the present invention will be described in detail.

FIRST EMBODIMENT

Figure 1:
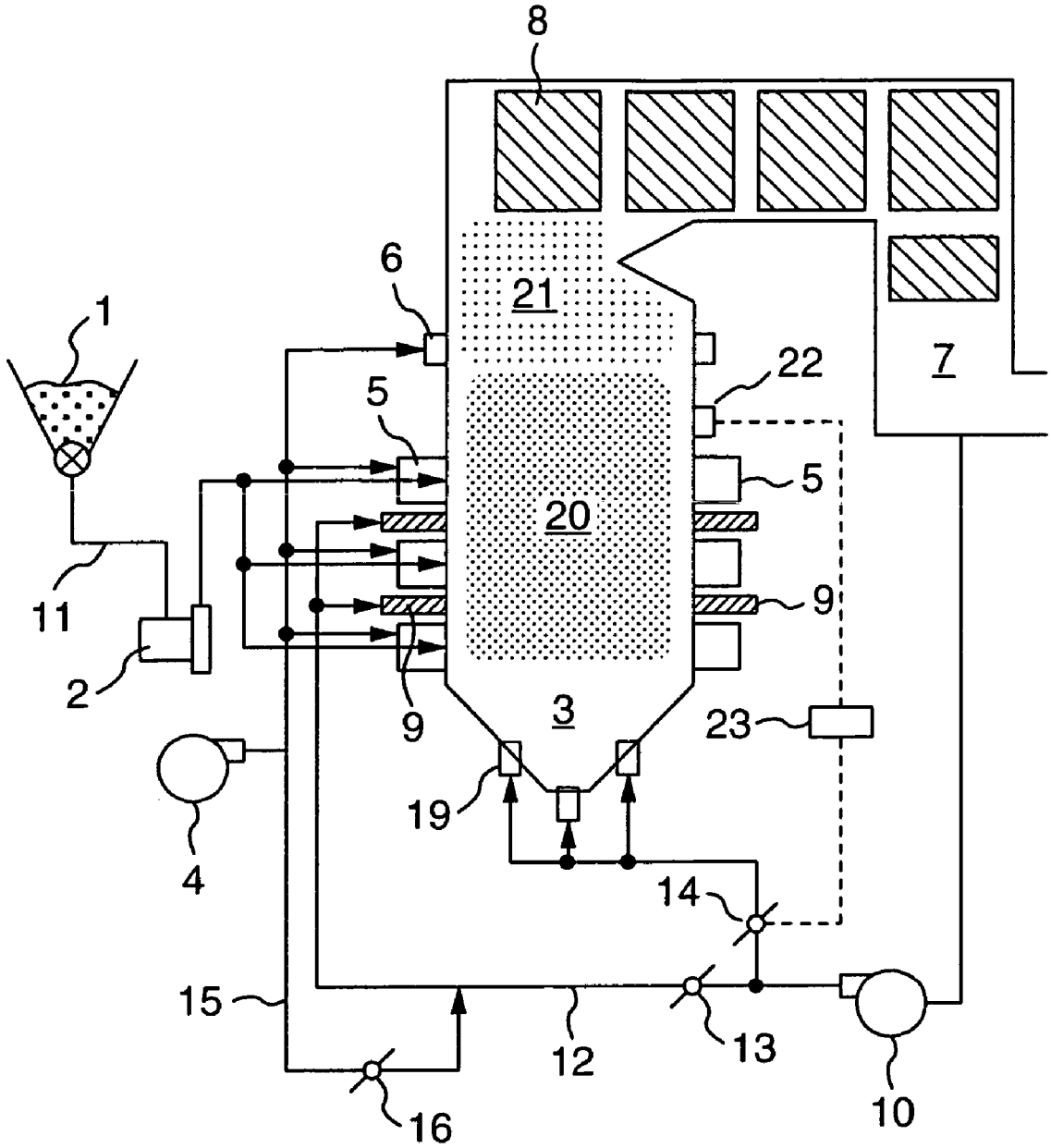
FIG. 1 is a schematic diagram of a pulverized coal boiler according to a first embodiment of the present invention.

A first embodiment according to the present invention will hereinafter be described with reference to FIGS. 1 and 2. FIG. 1 is a schematic diagram of a pulverized coal boiler according to the first embodiment of the present invention. In FIG. 1, fuel passes through a fuel supply apparatus 1 and a mill 2, and is supplied to burners 5 via a fuel supply tube 11. Air for combustion from a blower 4 is branched to burners 5 and after air ports 6 and supplied into the furnace 3. At this time, the air is adjusted in predetermined flow volumes by a damper (not shown). The combustion air supplied from the burners 5 into the furnace 3 is mixed with the fuel in the vicinity of the burners 5 (in a burner zone 20) and used for lean air combustion (reducing combustion).

Furthermore, the air flows upwards in the furnace 3, unburned carbon and carbon monoxide are burned in a region 21 in which the combustion air from the after air ports 6 is mixed, and the combustion exhaust gas is exhausted to a heat recovery area 7 via an upper part of the furnace 3. A heat exchanger tube group 8 is disposed over from the upper part of the furnace 3 to the heat recovery area 7.

FIG. 1 shows opposite combustion in which the burners 5 are disposed on front/rear furnace walls. However, similar effects are obtained in one surface combustion in which the burners are disposed on one wall or in corner firing in which the burners are disposed on the peripheral wall and corners to generate a swirl flow in the furnace 3.

Recirculation gas ports 9 for recirculating exhaust gas are disposed between the burners 5 of the furnace 3. A part of the exhaust gas is branched in the heat recovery area 7, flows back through a gas recirculation blower or fan 10 and piping 12, and is supplied into the recirculation gas ports 9.

Figure 2:
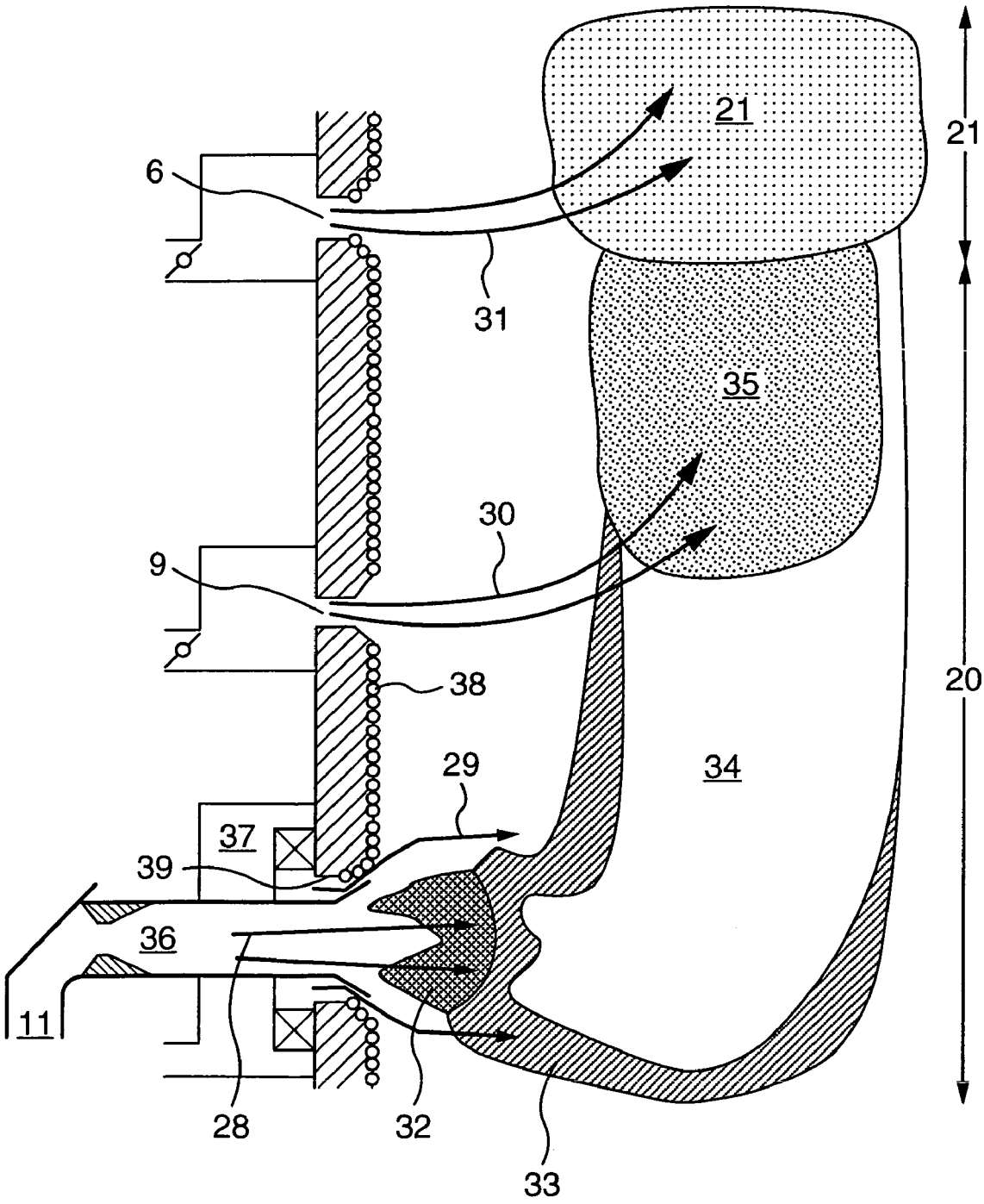
FIG. 2 is an explanatory view showing a relation between a burner flame and a recirculation gas injection in the present invention.

FIG. 2 is a schematic diagram showing combustion principle of the boiler according to the present invention. In FIG. 2, fuel 28 blown into the furnace via a fuel nozzle 36 of the burner is mixed with air 29, ignited in an ignition region (initial flame) 32, and flows upwards in the furnace in an oxidation region 33 which surrounds a reduction region 34.

Nozzles are preferably arranged in a wind box (air box 37). The air 31 is supplied to the flame 21 via the after air port 6, and the fuel is completely burned.

When a gas recirculation system is applied as shown in FIGS. 1 and 2, and the recirculation gas 30 is mixed in the burner zone 20, flame temperature drops due to thermal capacity of the exhaust gas. Further, since a combustion gas flow rate in the furnace increases, a residence time of the fuel in the burner zone shortens. Therefore, the flame temperature drops, and troubles by the stick of ash onto the furnace wall are not easily caused.

However, it is considered that when the recirculation gas is mixed from the furnace bottom as in the related art, the recirculation gas flows only through specific portions depending on a flow situation in the furnace. Further, in accordance with an example of the furnace including the burners disposed on opposite walls, when the recirculation gas flows along a burner mounting surface, it is possible to prevent from forming the flame in the burners mounted at the lower part of the furnace. This causes a possibility of unburned carbon and CO increase, the flame blowoff, or flameout. Especially in the burners disposed in a bottom stage, since the temperature of the surrounding furnace wall is low, the combustion is easily apt to be unstable.

Moreover, when the recirculation gas flows along the side wall, the recirculation gas does not flow through a furnace middle portion having a highest thermal load. Thus, it is possible to obtain no effect of the recirculation gas mixture. Since the temperature of the surrounding furnace wall is low, in the burners, especially in the burners disposed in a bottom stage, when the flame temperature is lowered by the recirculation gas, the combustion is easily apt to be unstable.

On the other hand, in the embodiment according to the present invention shown in FIG. 1, since the recirculation gas ports are disposed in the burner mounting surface, the recirculation gas can be effectively fed into the portion having the highest thermal load in the furnace. Therefore, the flame temperature can be lowered in the high thermal load portion. The temperature of ash on the furnace wall is lowered by the drop of the flame temperature, and ash stick troubles by the ash melting/softening can be inhibited from being caused.

Moreover, since the flame temperature is lowered, oxidation reaction into nitrogen oxide (NOx) from nitrogen in the air which becomes active at the high temperature can be inhibited. Therefore, NOx can be reduced in the furnace 3 outlet.

In the first embodiment shown in FIG. 1, the present invention is applied to the furnace in a two-stage combustion method in which the combustion air is supplied from the burners and the after air ports downstream thereof. Further, when the present invention is applied to a furnace in a single-stage combustion method for charging all the combustion air through the burners, the effect is the same.

Moreover, as shown in FIG. 1, as the recirculation gas is branched, the recirculation gas ports 9 are disposed on the burner mounting surface, and spouting ports 19 thereof may also be disposed in the furnace bottom. When branch amounts of the recirculation gas are adjusted by control valves 13, 14, thermal absorption in the furnace lower part can be adjusted. A relation between the burners and the recirculation gas ports is shown in FIGS. 3 to 6.

Figure 3:
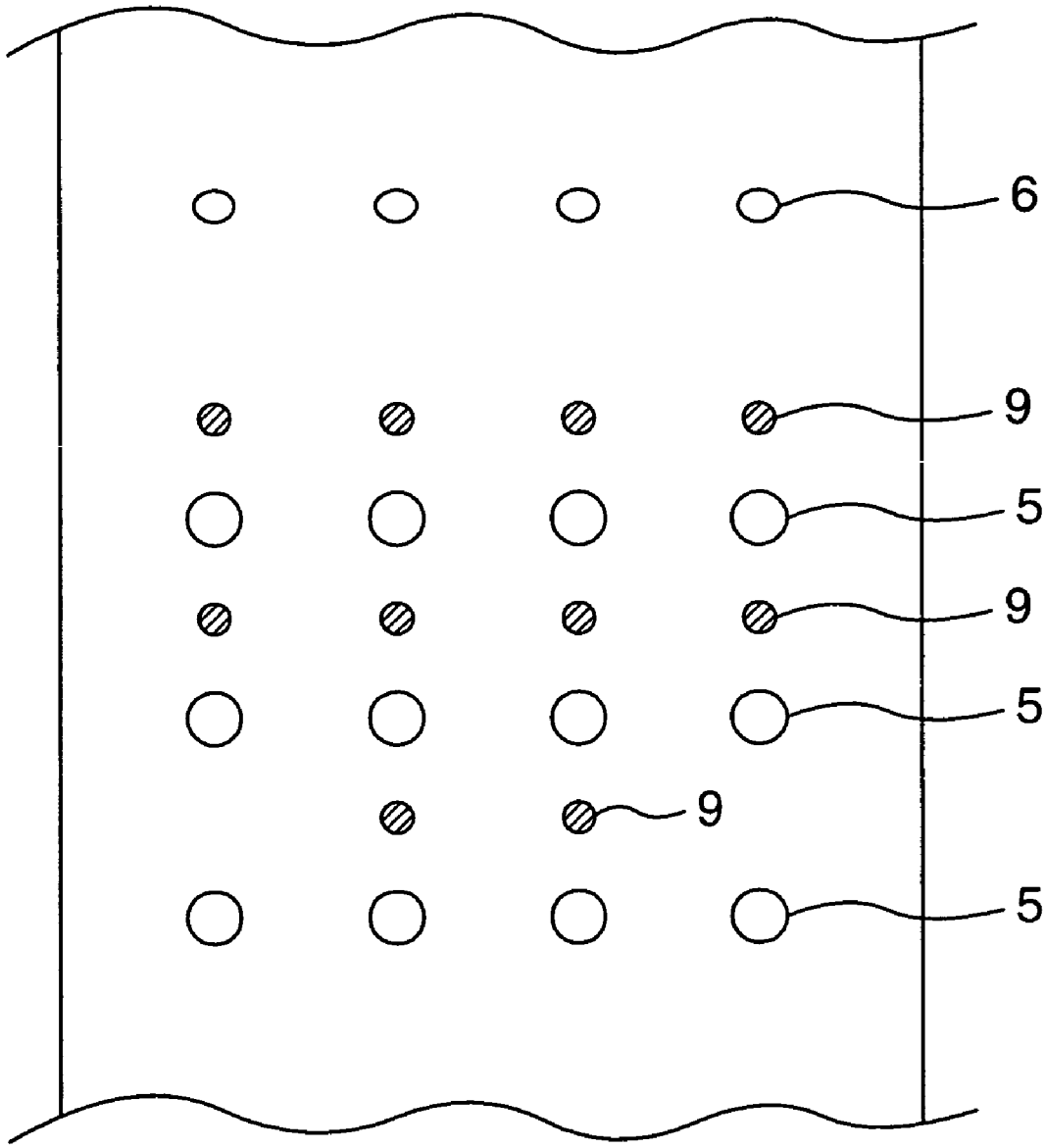
FIG. 3 is a front view showing one example of a method of disposing recirculation gas ports according to the present invention.
Figure 4:
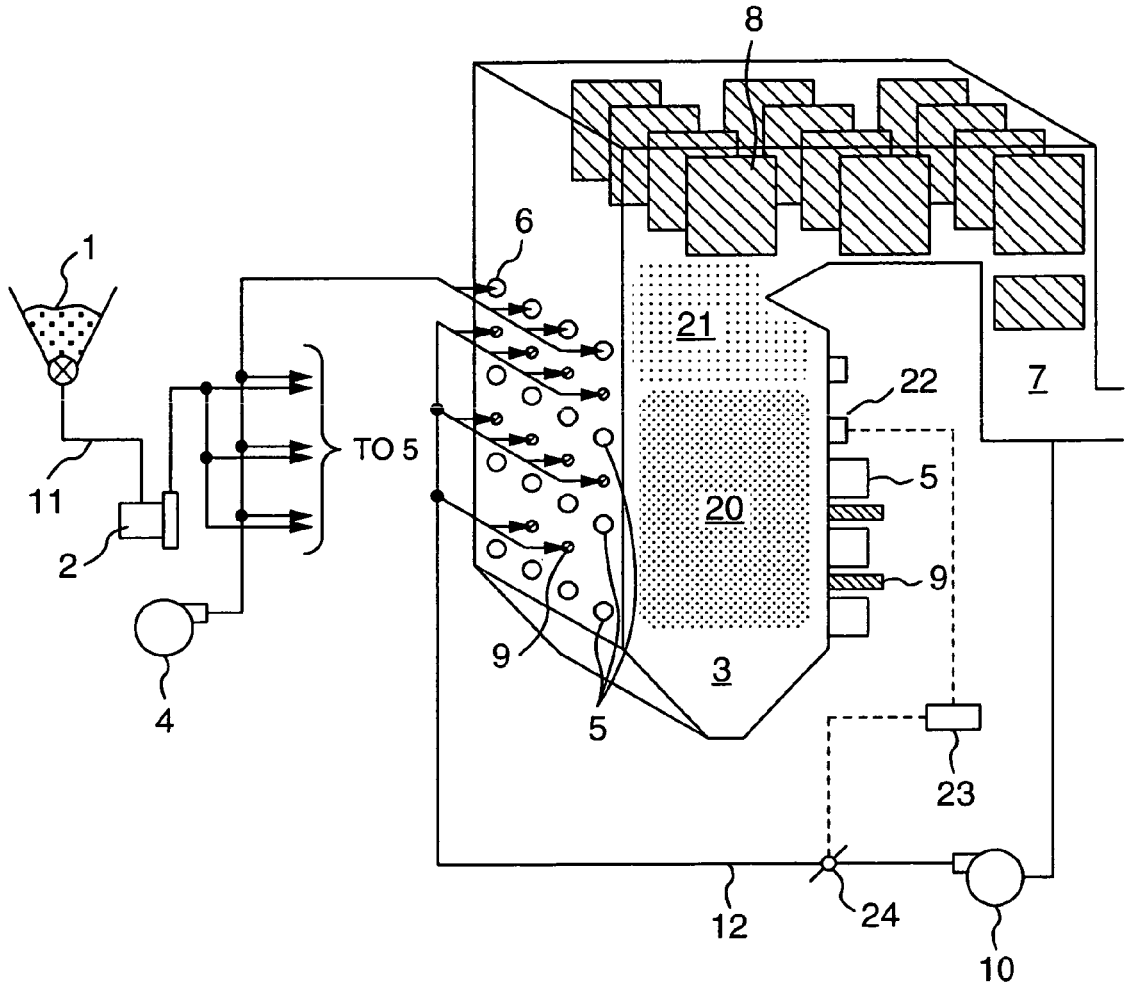
FIG. 4 is a perspective view of the boiler according to the example in FIG. 3.

FIG. 3 shows a partial view of the furnace 3 shown in FIG. 1 as seen from a front surface. FIG. 4 is a perspective view of the boiler including the furnace of FIG. 3, and shows a relation among the burners, after air ports, and recirculation gas ports. In FIG. 3, the respective circles show the recirculation gas ports and throat 39 portions in the nozzles of the burners. In this case, the supply ports of gas including the recirculation gas are arranged in a direction perpendicular to the burner columns (vertical columns in the drawing).

The fuel spouted from the burners spreads upwards by buoyancy. Therefore, when the recirculation gas ports are disposed above the burners, the recirculation gas easily reaches a high-temperature portion of the flame. Therefore, it is effective for the decrease of the flame temperature. In FIG. 4, the same reference numerals as those of FIG. 1 denote the same elements.

It is not a prerequisite to dispose the recirculation gas ports perpendicularly to the burner columns.

A distance between the recirculation gas port and the burner closest to the recirculation gas port among the burners is preferably set to a distance of 1.1 times or more, especially 1.3 times or more with respect to an outer diameter of the most constricted portion (throat portion) of the burner nozzle. Moreover, the most constricted portion of the recirculation gas port preferably has an outer diameter of 0.75 time or less with respect to the outer diameter of the most constricted portion (throat portion) of the burner nozzle.

When a distance between the recirculation gas port and the burner has the above-described relation, jet flows (initial flames) from the recirculation gas ports and the burners do not interfere with one another immediately after spouting, and thus, the spouting directions thereof are prevented from flow vibration.

Figure 5:
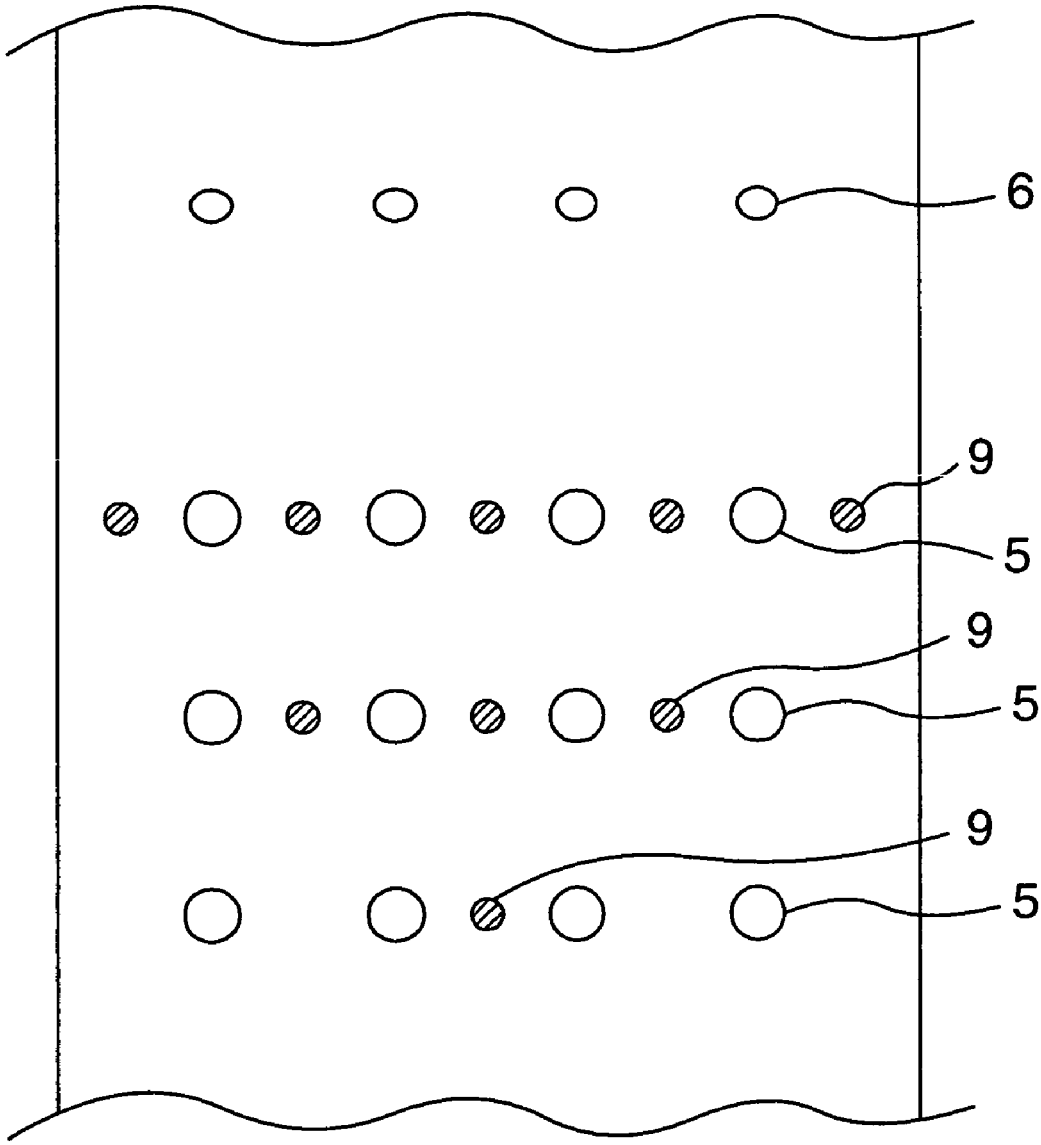
FIG. 5 is a front view showing another example of a method of disposing recirculation gas ports according to the present invention.

When the gas supply ports 9 are disposed in a horizontal direction of the burners as shown in FIG. 5, the recirculation gas ports are disposed on right and left sides of or above the burners 5 in the uppermost stage.

Figure 6:
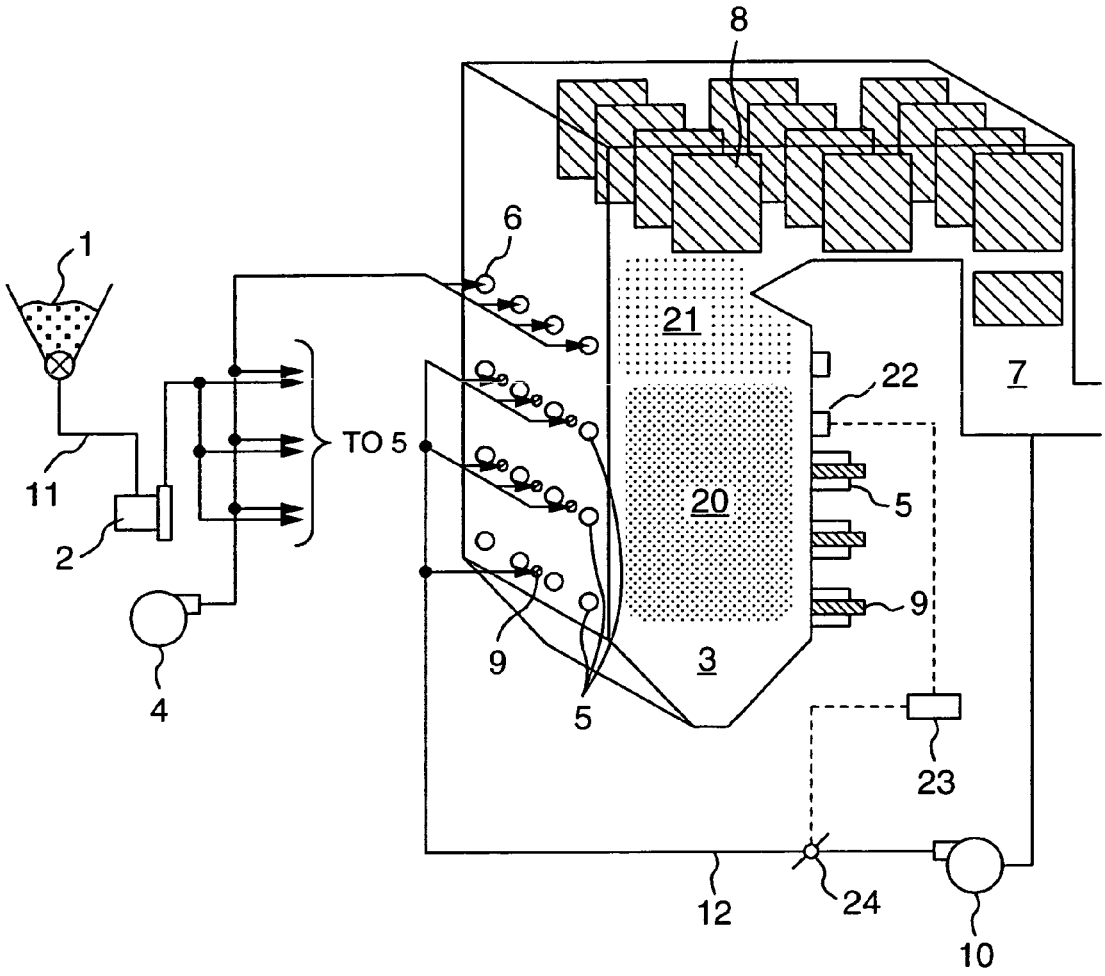
FIG. 6 is a perspective view of the boiler according to the example in FIG. 5.

FIG. 6 is a perspective view of a boiler including the furnace of FIG. 5. In FIG. 6, the same reference numerals as those of FIGS. 1, 4 denote the same elements. Since portions in the vicinity of a furnace central axis or in the vicinity of the uppermost-stage burners 5 receive a radiant heat from the flame formed by the ambient burners, the thermal load is especially apt to increase. To solve the problem, when the recirculation gas ports are disposed mainly in these portions, the maximum temperature of the flame is effectively lowered.

When the recirculation gas is supplied into the burner zone middle part having the high thermal load in the furnace, a maximum temperature of the flame can be lowered. By the decrease of the flame temperature, the temperature of the ash on the furnace wall is lowered, and the ash stick troubles by the softening/melting are inhibited from being caused. Also, with the decrease of the flame temperature, the oxidation reaction into nitrogen oxide (NOx) from oxygen in the air which becomes active at the high temperature (1500° C. or more) is inhibited, and thermal NOx is reduced.

In the embodiments shown in FIGS. 3 and 5, the distances from the burners disposed on a front wall 25 and a rear wall 26 in the furnace to the recirculation gas ports 9 are set to be one time or more than the diameter (hydraulic diameter) of the most constricted portion (throat portion) of the burner nozzle.

FIGS. 5 and 6 also show the boiler in the opposite combustion. Further, even in the one-surface combustion in which the burners are disposed on one wall, when the recirculation gas ports are disposed on the wall surface other than the burner mounting surface, the similar effect is obtained. Especially in the one-surface combustion, when the recirculation gas ports are disposed in the wall opposite to the burner mounting surface, the stick of the ash can effectively be suppressed.

As shown in FIG. 1, when piping 15 for introducing air into the piping 12 for recirculating the combustion exhaust gas to the furnace and a damper 16 are disposed, the gas spouted from the recirculation gas ports is a mixed fluid of the recirculation gas and air.

When a large amount of recirculation gas is supplied in order to well mix the fluid in the furnace, a region having an oxygen concentration of about 8% or less may be formed. In this region, the combustion reaction is interrupted by a rapid decrease of the oxygen concentration, and fuel particles are rapidly cooled. Even when the oxygen concentration increases again, the combustion reaction does not easily advance, and there is a possibility that the unburned carbon and carbon monoxide are increased.

When the concentration of oxygen is set to be higher than that of the recirculation gas, the region having an oxygen concentration of 8% or less can be prevented from being formed. Therefore, together with the decrease of the flame temperature, it is possible to continue the combustion reaction. It is not a prerequisite to raise the oxygen concentration of the recirculation gas.

A measuring unit 22 for measuring at least one of a radiant intensity of the flame, furnace wall temperature, and heat exchanger tube temperature is disposed on the furnace wall. A signal from the measuring unit 22 is connected to a boiler controller 23. It is possible to adjust a fuel or air flow volume by the boiler controller 23. In the present embodiment, the boiler controller 23 can send a signal to a control valve 24 for a recirculation gas flow volume.

When the signal of the measuring unit 22 exceeds a set condition of at least one of the radiant intensity of the flame, furnace wall temperature, and heat exchanger tube temperature, the flow volume of the gas spouted from the recirculation gas port is increased, and a maximum temperature of the flame is lowered. The ash stick trouble on the furnace wall can be prevented by the drop of the flame temperature. The reaction (thermal NOx reaction) in which NOx is generated from nitrogen in the air, is inhibited, and the NOx concentration exhausted from the furnace can be inhibited. This control system is also disposed in the example shown in FIG. 4.

The measuring unit 22 is disposed on the furnace wall as shown in FIG. 1, and may also be disposed in the lower or upper part of the furnace. For example, a non-contact type measuring unit such as a radiation intensity meter may also be disposed. The signal of an NOx concentration meter disposed in the heat recovery area may also be used. The thermal NOx reaction is activated in the high-temperature portion of the flame.

When this reaction is used to measure the behavior of the NOx concentration, it is possible to judge whether or not the high-temperature portion is formed in the furnace. When the NOx concentration is high, the flow volume of the gas supplied from the recirculation gas ports is increased, the maximum temperature of the flame is lowered, and NOx can be prevented from increasing by the thermal NOx reaction. The ash stick trouble onto the furnace wall surface can be prevented by the drop of the flame temperature.

According to the above-described embodiment of the present invention, when the supply ports of the gas containing the recirculation gas are disposed on the burner mounting surface, the recirculation gas can effectively be supplied into the portion having the highest thermal load in the furnace. Therefore, the flame temperature can be lowered in the portion having the high thermal load. By the decrease of the flame temperature, the temperature of the ash on the furnace wall can be lowered, and the generation of the ash stick trouble by the melting/softening can be inhibited.

Moreover, when the flame temperature is lowered, the oxidation reaction of nitrogen in the air, activated at the high temperature, into nitrogen oxide (NOx) can be inhibited. Therefore, the generation of NOx in the furnace outlet can be inhibited.

SECOND EMBODIMENT

Figure 7:
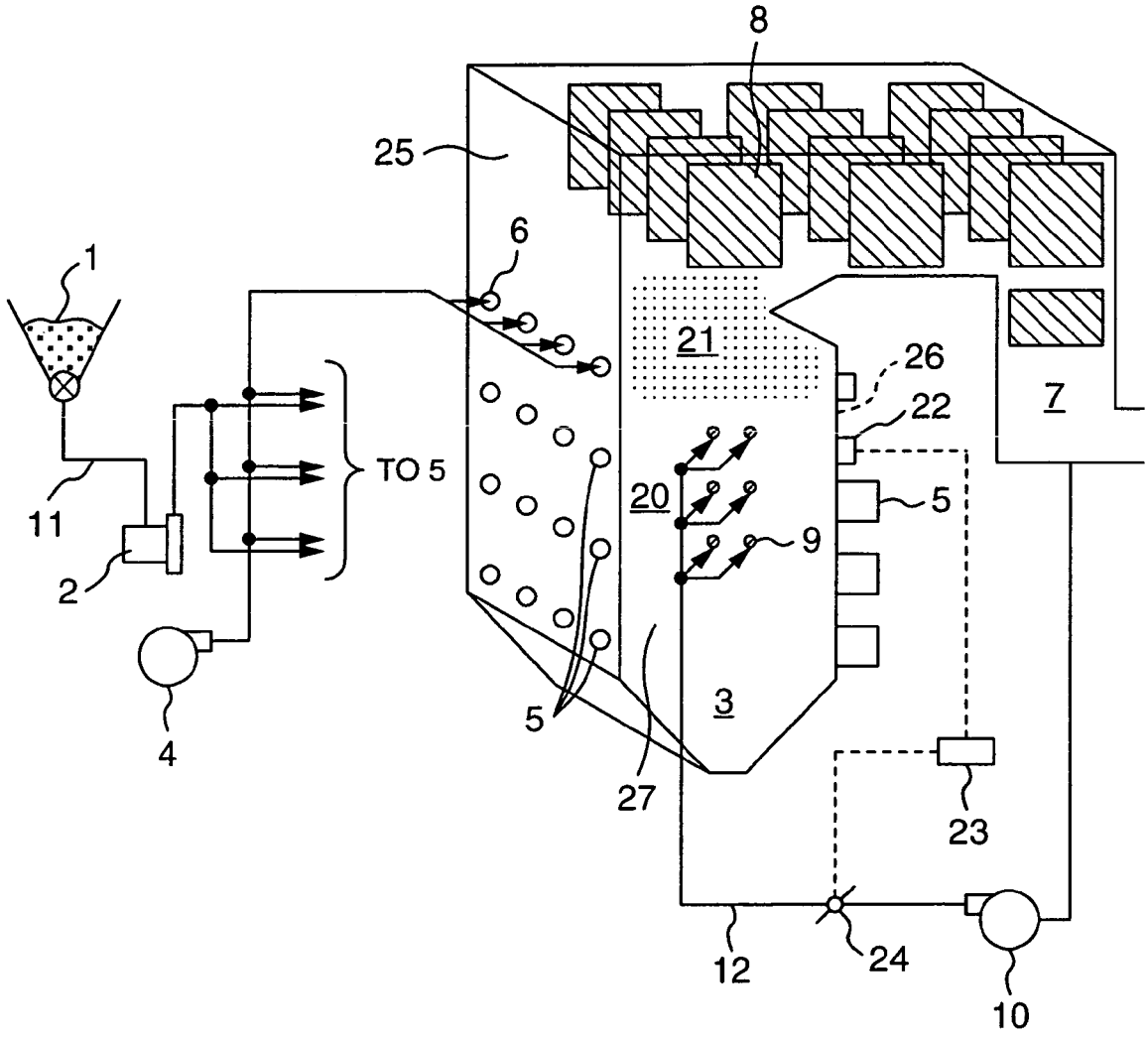
FIG. 7 is a schematic diagram of the pulverized coal boiler according to a second embodiment of the present invention.

FIG. 7 shows an example in which the recirculation gas ports are disposed on the furnace wall different from the mounting surface of the burners according to the present invention. In FIG. 7, the same reference numerals as those of FIGS. 1, 4, 6 denote the same elements.

In an opposite combustion boiler in which the burners 5 are disposed on the front wall 26 and rear wall 26 of the furnace 3, the fuel spouted from the burners collides at the furnace center, and a flow toward side walls 27 may be generated. At this time, fuel particles containing the ash are apt to collide with the side walls, and therefore the ash easily sticks to the side wall middle part especially having the high thermal load.

In the embodiment shown in FIG. 7, the recirculation gas ports 9 are disposed in the vicinity of the middle of the side wall 27. Thus, the flow toward the side walls 27 from the furnace middle is moderated by the jet flow of the exhaust gas from the supply ports 9. Since the ash does not easily collide with the side walls, the ash stick onto the side walls can be inhibited.

In this embodiment, the positions of the recirculation gas ports 9 do not correspond to the relation with the burner columns or stages as in the above-described embodiment, and the ports may be disposed in any position as long as the recirculation gas is mixed with the high-temperature reducing flame as shown in FIG. 2.

It should be further understood by those skilled in the art that although the foregoing description has been made on embodiments of the invention, the invention is not limited thereto and various changes and modifications may be made without departing from the spirit of the invention and the scope of the appended claims.

According to the present invention, the strong stick of the molten ash onto the furnace wall can be prevented, and thermal NOx, fuel NOx, and unburned carbon can be reduced.

What is claimed is:

1. A solid fuel boiler comprising:

a furnace including a furnace wall to perform horizontal firing;

a plurality of solid fuel burners mounted on the wall of said furnace, each including a fuel nozzle for spouting fuel and carrying gas therefor and an air nozzle for spouting air;

a plurality of air nozzles (after air ports) mounted on a wall surface of the furnace at a downstream side of the solid fuel burners and spouting air;

a duct through which a part of combustion exhaust gas recirculates to said furnace from a downstream portion thereof;

a recirculation gas port via which the part of the recirculation gas is supplied into the furnace; and heat exchanger tubes disposed on said furnace wall and in a heat recovery area of said furnace, wherein said recirculation gas port is disposed between the burner positioned on an uppermost-stream side and said after air port, and is apart from an outer periphery of a throat portion (the most constricted portion) of the air nozzle in the one burner by 1.1 to four times a diameter of the throat portion, and a mixed fluid of the recirculation gas and air is supplied from said recirculation gas port.

2. The solid fuel boiler according to claim 1, wherein a mixed fluid of air and the recirculation gas is used as a gas supplied from said after air ports.

3. A method of operating the solid fuel boiler according to claim 1, comprising the steps of: changing a flow volume and oxygen concentration of the gas supplied from the recirculation gas port and said after air port in accordance with an operation load of the furnace.

4. A method of operating the solid fuel boiler according to claim 1, comprising the steps of: changing a flow volume and oxygen concentration of the gas supplied from the recirculation gas port and said after air port in accordance with at least one of signals of a radiation intensity of the flame, a furnace wall temperature, a heat exchanger tube temperature by a sensor disposed on the wall of the furnace, and a NOx concentration obtained by NOx analyzer disposed in said heat recovery area of a furnace outlet.

5. A solid fuel boiler comprising:

a furnace including a furnace wall to perform horizontal firing;

a plurality of solid fuel burners mounted on the wall of said furnace, each including a fuel nozzle for spouting fuel and carrying gas therefor and an air nozzle for spouting air;

a plurality of air nozzles (after air ports) mounted on a wall surface of the furnace at a downstream side of the solid fuel burners for spouting air;

a duct through which a part of combustion exhaust gas recirculates to said furnace from a downstream portion thereof;

a recirculation gas port via which the part of the recirculation gas is supplied into the furnace; and heat exchanger tubes disposed on said furnace wall and in a heat recovery area of said furnace, wherein said recirculation gas port is disposed between the burner positioned on an uppermost-stream side and said after air port, and is apart from an outer periphery of a throat portion (the most constricted portion) of the air nozzle in the one burner by 1.1 to four times a diameter of the throat portion, and wherein said solid fuel boiler further comprises a flow volume adjusting device for mixing air to said recirculating duct for the combustion exhaust gas which duct is connected with said recirculating gas port.

6. The solid fuel boiler according to claim 5, further comprising piping connecting from said recirculating duct for the combustion exhaust gas to said after air port, and a flow volume adjusting device for mixing said recirculating gas with air supplied to said after air port.

7. A method of operating the solid fuel boiler according to claim 5, comprising the steps of: changing a flow volume and oxygen concentration of the gas supplied from the recirculation gas port and said after air port in accordance with an operation load of the furnace.

8. A method of operating the solid fuel boiler according to claim 5, comprising the steps of: changing a flow volume and oxygen concentration of the gas supplied from the recirculation gas port and said after air port in accordance with at least one of signals of a radiation intensity of the flame, a furnace wall temperature, a heat exchanger tube temperature by a sensor disposed on the wall of the furnace, and a NOx concentration obtained by NOx analyzer disposed in said heat recovery area of a furnace outlet.

9. A solid fuel boiler comprising:

a furnace including a front wall or rear waif and side walls to perform horizontal firing;

a plurality of solid fuel burners mounted on the front wall and rear wall of said furnace, each including a fuel nozzle for spouting fuel and carrying gas therefor and an air nozzle for spouting air;

a plurality of air nozzles (after air ports) mounted on a wall surface of the furnace at a downstream side of the solid fuel burners for spouting air;

a duct through which a part of combustion exhaust gas recirculates to said furnace from a downstream portion thereof;

a recirculation gas port via which the part of the recirculation gas is supplied into the furnace; and heat exchanger tubes disposed on said furnace wall and in a heat recovery area of said furnace, wherein said recirculation gas port is disposed between the burner positioned on an uppermost-stream side and said after air port, wherein said recirculation gas port is disposed in said furnace on said side walls and a sectional center of said recirculation gas port is positioned as high as or higher than that of the burners.

10. The solid fuel boiler according to claim 9, wherein a mixing fluid of said recirculating gas and air is used as a gas supplied from said recirculation port.

11. The solid fuel boiler according to claim 10, wherein a mixing fluid of said recirculating gas and air is used as a gas supplied from said after airport.

12. The solid fuel boiler according to claim 9, wherein a mixing fluid of said recirculating gas and air is used as a gas supplied from said after air port.

13. A method of operating the solid fuel boiler according to claim 9, comprising the steps of: changing a flow volume and oxygen concentration of the gas supplied from the recirculation gas port and said after air port in accordance with an operation load of the furnace.

14. A method of operating the solid fuel boiler according to claim 9, comprising the steps of: changing a flow volume and oxygen concentration of the gas supplied from the recirculation gas port and said after air port in accordance with at least one of signals of a radiation intensity of the flame, a furnace wall temperature, a heat exchanger tube temperature by a sensor disposed on the wall of the furnace, and a NOx concentration obtained by NOx analyzer disposed in said heat recovery area of a furnace outlet.

* * * * *